United States Patent [19]

Ogawa

[11] 4,183,173

[45] Jan. 15, 1980

[54] TOY ASSEMBLY WITH INTERCHANGEABLE PARTS AND DETACHABLE APPENDAGES

[75] Inventor: Iwakichi Ogawa, Kashiwa, Japan

[73] Assignee: Takara Co., Ltd., Tokyo, Japan

[21] Appl. No.: 890,919

[22] Filed: Mar. 28, 1978

[51] Int. Cl.[2] ..... A63H 33/10

[52] U.S. Cl. ..... 46/202; 46/22; 46/223

[58] Field of Search ..... 46/223, 221, 222, 202, 46/204, 206, 201, 22, 103, 104, 106, 107

[56] References Cited

U.S. PATENT DOCUMENTS

| | | | |
|---|---|---|---|
| 2,545,155 | 3/1951 | Logan | 46/201 X |
| 2,791,867 | 5/1957 | Dasher | 46/223 X |
| 3,169,345 | 2/1965 | Marmo et al. | 46/241 |
| 3,224,137 | 12/1965 | Wright et al. | 46/221 X |
| 3,375,604 | 4/1968 | Alonso | 46/221 X |
| 3,594,949 | 7/1971 | Tam | 46/202 |
| 3,596,397 | 8/1971 | Colletti | 46/202 X |
| 3,619,943 | 11/1971 | Goodbody | 46/221 |
| 3,629,968 | 12/1971 | Linstead | 46/223 X |
| 3,811,218 | 5/1974 | Salmon et al. | 46/223 X |
| 4,038,775 | 8/1977 | Sato | 46/22 |

FOREIGN PATENT DOCUMENTS

| | | | |
|---|---|---|---|
| 1275450 | 10/1961 | France | 46/221 |

*Primary Examiner*—John F. Pitrelli

*Attorney, Agent, or Firm*—Jackson, Jones & Price

[57] ABSTRACT

A toy vehicle includes a main body portion adapted to removably secure a front wheel unit, a rear wheel unit and a top cover. The body portion and removable components are provided with matching grooves and protrusions so as to allow interchangeable assembly of the parts by children in the course of play. The front wheel unit can provide both a cantilevered mounting of the axle and a displacement of the respective wheels in an operative position. The rear wheel can further incorporate a powered motor. In addition the rear wheel unit is provided with a joint assembly for the removable mounting of a trunk portion of a robot doll or a toy airplane.

3 Claims, 7 Drawing Figures

FIG. 1
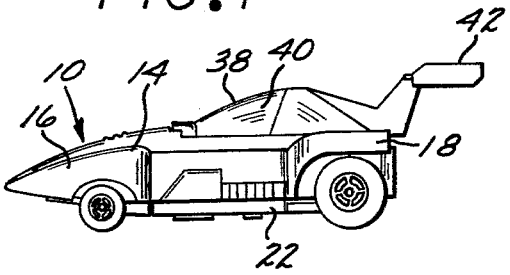
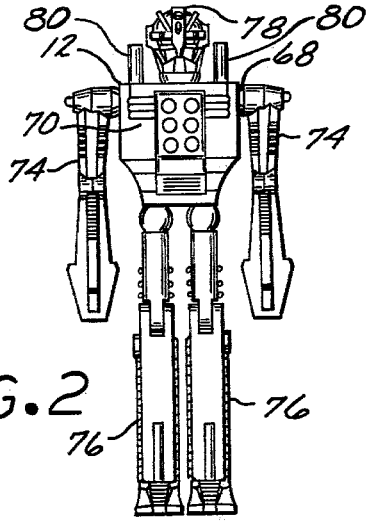
FIG. 2
FIG. 3
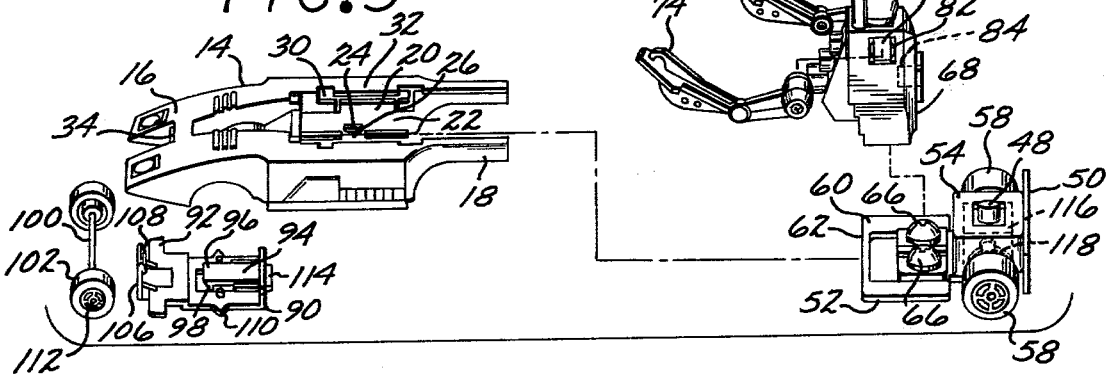
FIG. 5
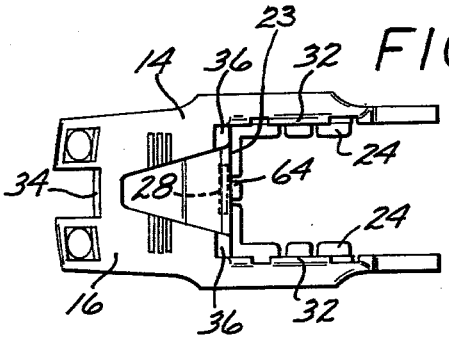
FIG. 4
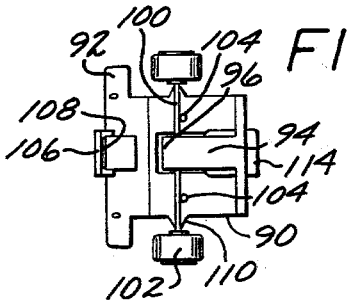
FIG. 7
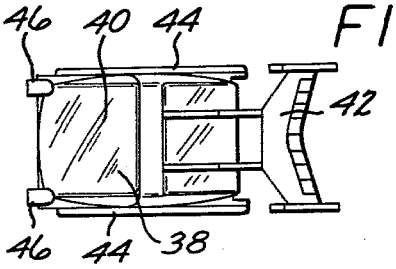
FIG. 6
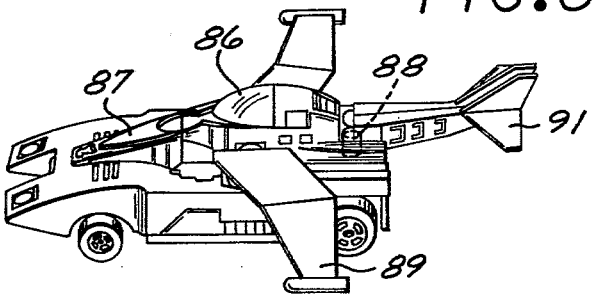

TOY ASSEMBLY WITH INTERCHANGEABLE PARTS AND DETACHABLE APPENDAGES

BACKGROUND OF THE INVENTION

1. Field of the Invention

The present invention is directed to a toy assembly and more particularly to a toy vehicle which is readily assembled by a child from subcomponent parts, and which is capable of supporting a number of accessory parts such as a robot doll, canopy or toy airplane parts.

2. Description of the Prior Art

Toy cars having a diecast or similarly manufactured body are well known in the toy trade. Toy cars of this type usually have a pair of front and a pair of rear wheels rotatably but fixedly mounted to the car body. Some of the toy cars known in the prior art are equipped with a motor to propel the toy vehicle. The motor may be a battery operated electric motor, or may be energized by a windable spring or a fly-wheel.

Frequently the toy vehicles of the prior art include a doll or robot sitting in a driver's seat. Customarily such dolls either comprise an integral part of the main body of the toy vehicles or are permanently attached thereto, and a child playing with the toy vehicles cannot remove the doll during play. Alternatively, the doll figure is simply rested within the vehicle.

Due to the inherent nature of the toy market, the toy industry is constantly striving to provide toys of new and useful features which challenge the creative imagination and manual skills of the children.

SUMMARY OF THE INVENTION

An object of this invention is to provide a toy vehicle which is assembled from component parts including a novel wheel module, by its child user.

Another object of this invention is to provide a toy vehicle to which various toy objects such as a doll or a toy airplane can be attached by a child.

Still another object of this invention is to provide a series of toy vehicles having interchangeable parts and interchangeable toy objects so that a child can interchange the parts and toy objects in the course of play.

The above stated and other objects are attained by a toy vehicle having a main body, a front wheel assembly, a rear wheel assembly and an accessory unit. The front wheel assembly is mounted to the main body by a pawl member engaging a ledge and by a protrusion fitting into a slot in the main body.

The front wheel unit further has a base member and a cantilevered support member which has a downwardly projecting protrusion on its unsupported end. An axle, interconnecting a pair of wheels, is snappingly received and held by the cantilevered support member. A pair of prongs projecting upward from the base member insure alignment of the axle between the downward projecting portion of the support member and the prongs. A protruding portion of the base member on each side of the base member, aligned with the axle interconnecting the wheels, fixedly positions the wheels against any movement of the axle.

The main body incorporates longitudinal grooves into which fit matching protrusions provided in the rear wheel assembly.

The accessory unit may be a canopy made out of transparent material which is also mounted into the longitudinal grooves of the main body. Other accessory units may comprise a toy doll, or a toy airplane. The toy doll may be mounted to a magnetic joint provided in the rear wheel assembly.

The rear wheel assembly is also provided with an upwardly projecting male shaft, which can be received by an aperture incorporated in the toy doll and in the toy airplane, thus permitting the removable mounting of the toy doll or airplane to the toy vehicle. The rear wheel unit may be of the type having freely rotating wheels or wheels driven by a motor.

The various features of the present invention will be best understood, together with further objects and advantages by reference to the following description of the preferred embodiments, taken in connection with the accompanying drawings.

BRIEF DESCRIPTION OF THE DRAWINGS

FIG. 1 is a side perspective view of a specific embodiment of the present invention;

FIG. 2 is a front view of a doll which may serve as an appendage to a specific embodiment of the present invention;

FIG. 3 is an exploded side perspective view of another specific embodiment of the present invention;

FIG. 4 is a top view of the front wheel assembly of a specific embodiment of the present invention;

FIG. 5 is a top view of the main body portion of a specific embodiment of the present invention;

FIG. 6 is a side perspective view of yet another specific embodiment of the present invention, and FIG. 7 is a top view of the canopy portion of a specific embodiment of the present invention.

DESCRIPTION OF THE PREFERRED EMBODIMENTS

The following specifications taken in conjunction with the drawings set forth the preferred embodiments of the present invention in such a manner that any person skilled in the toy car manufacturing arts can use the invention. The embodiments of the invention disclosed herein are the best modes contemplated by the inventor for carrying out his invention in a commercial environment, though it should be understood that various modifications can be accomplished within the parameters of the present invention.

Referring now to FIGS. 1 and 2 a preferred embodiment of the invention is disclosed. FIGS. 1 and 2 respectively, show a toy vehicle 10 and a humanoid doll 12.

The toy vehicle 10 has a chassis body 14 which is readily manufactured, e.g. by die-casting or plastic injection molding. The chassis body 14 has a substantially hood shaped front portion 16 and a rear fender portion 18. A substantially U shaped bottom body member 20 is fastened to the lower rear of the chassis body 14. The bottom body member 20 has a side plate 22 on each side of a base plate 23, these plates form the stems of the configuration U and are disposed parallel to the longitudinal axis of the toy vehicle 10. Each side plate 22 is provided with a plurality of protrusions 24, extending inward transverse to the longitudinal axis of the toy vehicle. At least one of such protrusions 24 on each side plate 22 is placed above a plane containing the other protrusions 24 so as to create therebetween respective lower channels or grooves 26 which are parallel to the longitudinal axis of the toy vehicle 10. The substantially U shaped bottom body member 20 incorporates a slot 28, shown in FIG. 5, located substantially in the center of the base plate 23, which comprises the base of the U configuration. The slot 28 is adjacent to the front end of the toy vehicle 10, and as will be discussed below, is utilized for the mounting of the front wheel assembly.

The chassis body 14 of the toy vehicle 10 is also provided with upper channels or grooves 30 in both the right and left side of the rear fender portion 18. The upper channels or grooves 30 are disposed parallel to the longitudinal axis of the toy vehicle 10 and are formed between a plurality of upper protrusions 32 in a manner similar to the lower channels or grooves 26.

The hood shaped front portion 16 of the chassis body 14 incorporates an indentation which forms a ledge 34 in the approximate front center of the hood 16. Two more indentations each forming a mounting recess 36 are provided in the rear top of the hood shaped front 16 of the chassis body 14. The purpose of the above described grooves and mounting recesses will be best understood as the mounting of the various component parts and accessory units to the chassis body 14 are described below.

While the above described toy vehicle 10 incorporates the chassis body 14 and the U shaped bottom body member 20 mounted thereto, the toy vehicle 10 of this invention may be manufactured from an integral chassis body which would then incorporate the above described channels, recesses and the like to be utilized for mounting of the various component parts and accessory unit. Similarly, while the above described construction and configuration of the protrusions and grooves is preferred and is practical from a manufacturing standpoint, it would be possible to practice the present invention by using a different configuration of grooves and protrusions.

A canopy 38 shown in FIGS. 1 and 7 can be removably mounted to the vehicle body as an accessory unit. The canopy 38 is preferably made from a transparent plastic material, having a substantially arc shaped body member 40, a wing shaped tail 42, and protruding lower side members 44 on either side. Two protrusions or prongs 46 are also provided on either side of the front of the body member 40.

When mounting the canopy 38 to the chassis body 14, the protruding side members 44 of the canopy 38 are simply inserted into the upper channels or grooves 30 provided on either sides of the rear fender portion 18 of the chassis body 14, and slid forward until the prongs 46 are positioned over the mounting recesses 36. The prongs 46 are constructed in such a manner that sliding the prongs 46 over mounting recesses 36 slightly bends the prongs 46 in an upwardly direction to provide a friction fit. A spring force created by the upward bending of the prongs 46 assists in keeping the canopy 38 in operative position over the toy vehicle 10. The lower portion of the canopy 38 has a centrally located notch (not shown) in order to permit the canopy 38 to slide across a male shaft 48 extending upward from a rear wheel unit 50. The purpose of the male shaft 48 will be explained subsequently.

Referring to FIG. 3, a detailed construction of the rear wheel unit 50 is disclosed. Upon a rear base plate 52 having a vertical L shaped cross section is mounted a body shaped hollow member 54. An aperture (not shown) placed in the bottom of the box shaped hollow member 54 accomodates an axle 56 interconnecting rear wheels 58. Forward and rearward sliding motion of the axle 56 is prevented by two pairs of small prongs (not shown) within the hollow member 54 projecting upward from the rear base plate 52, the axle 56 being placed between the prongs.

The rear wheels 58 are prevented from coming into contact with the box shaped hollow member 54 by small triangular protrusions (not shown); one such protrusion is located on each side of the rear base plate 52 underneath axle 56. The pointed end of the protrusion provides a minimal friction contact with a flat circular contact face on the hub of a rear wheel 58. Similar protrusions serving an identical function will be described with regard to a front wheel assembly unit shown in FIG. 4.

A horizontal portion 60 of the base plate 52 is dimensioned so as to slideably fit along its lateral periphery into the longitudinal lower grooves or channels 26 provided in the U shaped bottom member 20. The foremost periphery 62 of the horizontal portion 60 is further engaged by an additional channel or groove 64, shown in FIG. 5, which is located in the bottom body member 20. This channel or groove 64 lies in a direction perpendicular to the longitudinal axis of the toy vehicle 10. The respective dimensions of the channels or grooves 26 and 64 in the bottom body member 20, and the matching periphery of horizontal portion 60 are such as to readily permit slideable attachment, while at the same time generating enough friction to firmly hold the rear wheel unit 50 to the toy vehicle 10.

The rear wheel unit 50 has a pair of substantially hemispherical shaped knobs 66 mounted to the horizontal portion 60 in front of but not immediately adjacent to the box shaped hollow member 54. The knobs 66 are made of magnetic or magnetizable material, and are suitable for removable attachment of objects held thereto by magnetic forces. FIG. 3 illustrates a trunk portion 68 of a doll or robot 70 which can be attached to the knobs 66. The doll body or trunk portion 68 is also shown in FIG. 2. The humanoid doll or robot 70 shown in FIG. 2 incorporates a permanent magnet 72 in the trunk or body portion 68 and has magnetically attachable arms 74, legs 76, and a head 78. The arms 74 and legs 76 of doll or robot 70 are jointed to simulate the corresponding human limbs. The trunk portion 68 of the doll 70 is configured to simulate, when the head 78, arms 74, and legs 76 are removed, a motor and is provided with two simulated exhaust pipes 80. The trunk portion 68 of the doll 70 incorporates magnetic pole pieces 82 in addition to the permanent magnet 72, and the head 78, arms 74 and legs 76 are attached to these magnetic pole pieces 82 via magnetic forces. The magnetic pole pieces have arcuate edges complimentary to the hemispherical knobs 66 which are located in the rear wheel unit 50. Consequently when the leg appendages 76 of the doll or robot 70 are removed, the rest of the robot can be attached, via magnetic forces, to the spherical knobs 66 thereby placing the trunk of the doll in the driver's seat of the toy vehicle 10.

The essential features of doll or robot 70 described above are disclosed in U.S. Pat. No. 4,038,775, and the specifications and drawings of U.S. Pat. No. 4,038,775 are hereby expressly incorporated by reference. Accordingly the doll or robot 70 described here, can be constructed to correspond to those specifications.

Referring again to FIG. 3, the male shaft 48 projects upwards from the box shaped hollow member 54. This male shaft 48 is designed to slideably fit into an aperture in various toy objects. For example an aperture 84 may be provided in the back of doll trunk 68 thus the entire doll or robot 70 may be mounted in a prone position on top of the toy vehicle 10 by inserting the male shaft 48 into the aperture 84. In addition as briefly noted above, the front configuration of the trunk 68 of the doll 70 is configured to represent the top of a car engine with exhaust pipes 80 extending therefrom. By removing all of the appendages from the trunk 68, the trunk 68 can be positioned on the shaft 48 to simulate a high power engine.

FIG. 6 shows another embodiment of the present invention wherein a toy airplane fuselage 86 is mounted on top of the toy vehicle 10. The toy airplane fuselage 86 is mounted in the same manner as the above mentioned trunk engine 68 by utilizing the male shaft 48 and an aperture 88 in the toy airplane. The various component parts of the toy airplane such as nose cone 87, wing 89 and tail sections 91 may be held together by magnetic means as taught by U.S. Pat. No. 4,038,775.

Referring to FIGS. 3 and 4, a front wheel assembly 90 of a preferred embodiment of the present invention is disclosed. A front base plate 92 has a cantilevered portion 94. The cantilevered portion 94 is in a plane parallel to the front base plate 92 and its free end 96 terminates in a downwardly pointing protrusion 98. An axle 100 interconnects a pair of front wheels 102 and is mounted by being pushed under the cantilevered portion 94 until it is snappingly received thereby. The axle 100 is held in an operating position by the downwardly pointing protrusion 98 and by a pair of small alignment prongs 104 projecting upward from base plate 92.

An orthogonal portion 106 projects upward from the foremost periphery of base plate 92. The orthogonal portion 106 terminates in a pawl member 108 which is utilized, as it will be described subsequently, for mounting the front wheel assembly 90 to the toy vehicle 10.

The front wheels 102 are prevented from coming into contact with the side periphery of the front base plate 92 by triangular shaped protrusions 110 which extend from base plate 92 and are located underneath the front axle 100. Since only the pointed ends of these two protrusions 110, one being on either side of the front base plate 92, may be in contact with a flat hub portion of the front wheels 102, less friction is generated when the wheels are rotated than if the wheels were in direct contact with the base plate 92.

Furthermore by molding the base plate 92 in a shape having the triangular protrusions 110 on the side, a simple pin type axle 100 provided with an enlarged head on both ends 112 may be utilized for the mounting of the front wheels 102. The enlarged heads on the ends of the axle 112 prevent outward movement of the wheels 102 on the axle 100 while the triangular protrusions 100 prevent the wheels 102 from coming into direct contact with the front base plate 92.

The front base plate 92 of the front wheel assembly 90 further includes a protruding member 114 projecting rearward from substantially the center of the rear periphery of the base plate 92. On mounting the front wheel assembly 90 to the vehicle body 10, the protruding member 114 is inserted into the slot 28 provided in the front of the U shaped bottom body member 20, and the pawl member 108 is hooked onto the ledge 34 located in the approximate front center of the hood of the chassis body 14. The respective dimensions of protruding member 114, slot 28 and pawl member 108 are such that the front wheel unit 90 is securely but removably held in position.

It is to be understood that the present invention incorporates the concept that additional specific embodiments of various component parts are possible, and these are to be designed in such a manner that they will be interchangeable with other component parts, thus further encouraging creative play by the child user of the invention.

As shown symbolically in FIG. 3 a suitable motor 116 energized by an electric battery, a windable constant tension spring or by a fly wheel, could be housed in the box shaped hollow member 54. Such motor 116 could drive the rear wheels 58 through suitable gears 118. A battery to drive an electric motor may be located in the toy vehicle itself especially in view of the fact that one of the accessory units could be readily adapted for battery storage. Alternatively the requisite electric power could be supplied through rails; such various means of energizing the motor intended to be within the scope of the present invention.

It should be readily apparent from the above description that a child can assemble the various component parts of the toy vehicles comprising the present invention, and can readily attach the various toy appendages thereto. Thus after having assembled the rear wheel unit 50 and the front wheel unit 90 to the toy vehicle 10 the child has the option to mount canopy 38 on the top of the toy vehicle 10. Alternatively, the child can remove the leg appendages 76 from the doll or robot 70 and mount the remaining body of the doll 70 into the driver's seat via the hemisphere shaped knobs 66. As yet another alternative the child can remove the leg 76, arm 74 and head 78 appendages from the robot 70 and attach the trunk portion 68 to the toy vehicle 10 via the male shaft 48. In this latter case the trunk portion 68, as attached to the toy vehicle 10 simulates the appearance of a high powered car engine. As still further play option the child can mount the entire doll or robot 70 on top of the toy vehicle 10 in a prone position via the male shaft 48 and aperture 84 in the back of the doll 70. As yet another alternative the child can mount the entire toy airplane 86 on top of the toy vehicle by utilizing the male shaft 48 and the corresponding aperture 88 in the toy airplane 86.

Obviously many modifications and variations of the present invention are possible in light of the above description. It is therefore to be understood that the scope of the present invention should be determined solely from the following claims.

What is claimed is:

1. A combination toy vehicle and doll assembly comprising:

a vehicle body member having a plurality of retaining grooves;

a front wheel assembly operatively attached to the vehicle body member, including a base plate, a cantilevered support plate extending from the base plate, retaining means on the support plate, a pawl member, a pair of wheels and an axle interconnecting the wheels;

alignment means complimentarily positioned on the base plate relative to the retaining means to operatively position the axle for rotatable support of the vehicle body member, the retaining means on the cantilevered support plate comprising a protrusion projecting downward from the support plate whereby the front wheel assembly is capable of snappingly receiving and holding the axle interconnecting the wheels, the alignment means complimentarily positioned on the base plate comprise a plurality of prongs and the base plate further comprises a pair of protrusions positioned underneath the axle interconnecting the wheels and projecting outward to prevent sliding of the wheels along the axle and wherein the front wheel assembly is operatively attached to the vehicle body member by the pawl member;

a rear wheel assembly operatively attached to the vehicle body member and having a base plate of complimentarily configuration to the retaining grooves, the rear wheel assembly being attached to the vehicle body member by sliding the base plate into the grooves;

an articulated doll assembly having removable appendages attached to a trunk member, the trunk member configured to simulate a vehicle engine and having means for attachment to the rear wheel assembly, and means on the rear wheel assembly to attach the doll assembly to simulate one of a vehicle operator and an engine whereby the child has a plurality of toy options.

2. The invention of claim 1 wherein the means included in the rear wheel assembly to attach the doll comprises coupling members that are magnetizable.

3. The invention of claim 1 further including a canopy and means to attach the canopy to the toy vehicle comprising a plurality of grooves in the vehicle body member and portions of the canopy fitting the grooves, the canopy being attached to the toy vehicle by sliding the portions of the canopy into the grooves.

* * * * *